United States Patent [19]

Takeuchi et al.

[11] Patent Number: 4,616,427

[45] Date of Patent: Oct. 14, 1986

[54] VACUUM CONVEYOR SYSTEM

[75] Inventors: Tsunezo Takeuchi, Aichi; Isao Mizutani, Nagoya, both of Japan

[73] Assignee: NGK Insulators, Ltd., Japan

[21] Appl. No.: 779,123

[22] Filed: Sep. 23, 1985

[30] Foreign Application Priority Data

Sep. 28, 1984 [JP] Japan ..... 59-204373

[51] Int. Cl.[4] ..... F26B 19/00

[52] U.S. Cl. ..... 34/92; 34/236

[58] Field of Search ..... 34/1, 4, 15, 92, 236; 198/471.1, 803.5

[56] References Cited

U.S. PATENT DOCUMENTS

| | | | |
|---|---|---|---|
| 2,635,352 | 4/1953 | Phillips | 34/1 |
| 3,941,233 | 3/1976 | Aivola | 198/471.1 |
| 3,952,860 | 4/1976 | Specht | 198/189 |
| 3,955,286 | 5/1976 | Anrep | 34/15 |
| 4,075,767 | 2/1978 | Kai et al. | 34/92 |
| 4,085,517 | 4/1978 | Thiel | 34/236 |
| 4,088,220 | 5/1978 | Jacksch et al. | 198/472 |
| 4,256,944 | 3/1981 | Brandon | 34/1 |
| 4,330,946 | 5/1982 | Courneya | 34/1 |
| 4,370,534 | 1/1983 | Brandon | 34/1 |

FOREIGN PATENT DOCUMENTS 1953193 10/1969 Fed. Rep. of Germany .

OTHER PUBLICATIONS

European Search Report EP 85206902.7–3 pages.

*Primary Examiner*—Albert J. Makay
*Assistant Examiner*—David W. Westphal
*Attorney, Agent, or Firm*—Parkhurst & Oliff

[57] ABSTRACT

A vacuum conveyor system including a conveyor having plural mounting portions on which workpieces are mounted in spaced-apart relation along an endless track, comprising: plural enclosure devices provided on the plural mounting portions of the conveyor, respectively, for forming air-tight enclosed chambers in which the workpieces mounted on the mounting portions are accommodated, respectively; a vacuum source for drawing an atmosphere from the enclosed chambers; and a suction piping assembly disposed along the conveyor and travelling together with the conveyor along the endless track, the suction piping assembly being connected to the vacuum source and having connections which are adapted to communicate with the enclosed chambers to evacuate the enclosed chambers to a predetermined reduced pressure.

13 Claims, 16 Drawing Figures

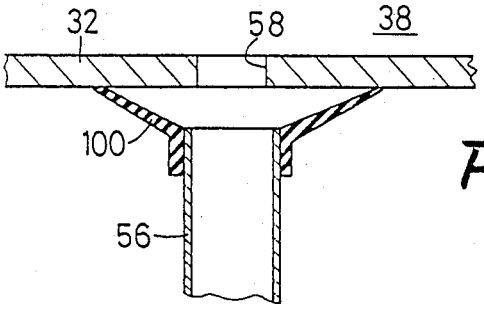
FIG. 7
FIG. 8
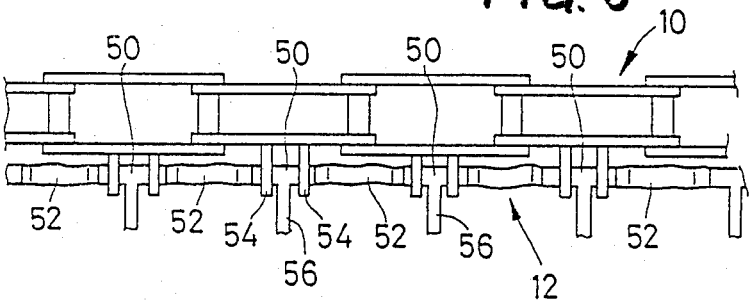
FIG. 9
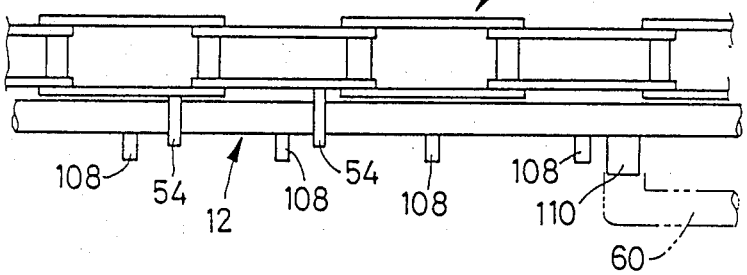
FIG. 10
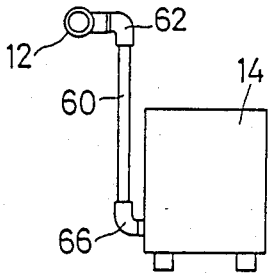

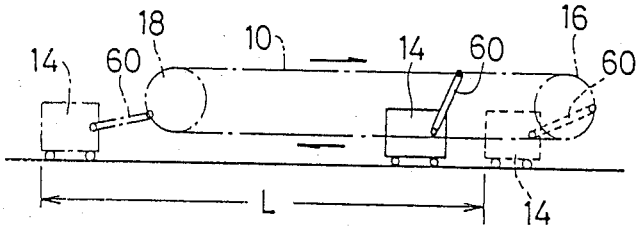
FIG. 11
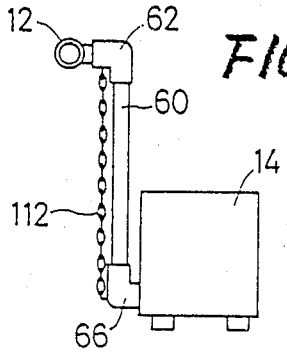
FIG. 12
FIG. 13
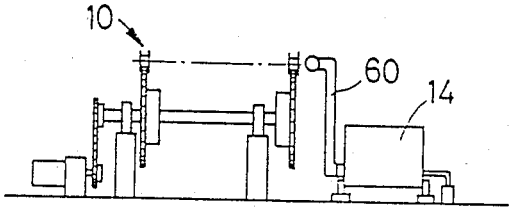
FIG. 14
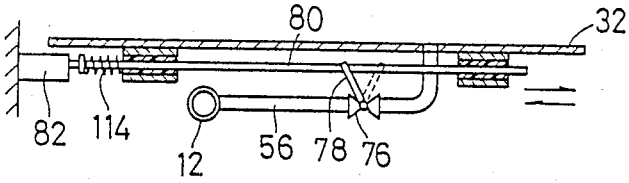
FIG. 15
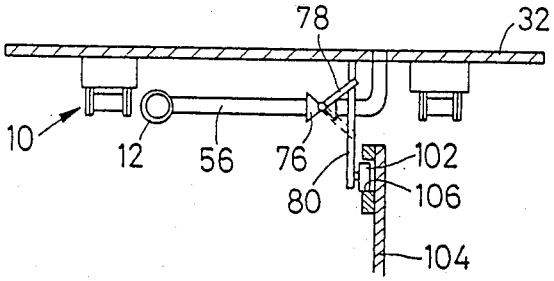
FIG. 16
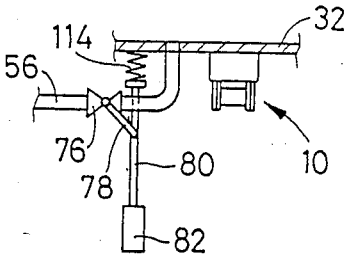

VACUUM CONVEYOR SYSTEM

BACKGROUND OF THE INVENTION

1. Field of the Art

The present invention relates generally to a vacuum conveyor system for transferring workpieces under vacuum (more precisely, under a partial vacuum, i.e., under a reduced pressure), and more particularly to such a vacuum conveyor system suitable for drying or other operations under a reduced pressure.

2. Related Art Statement

Generally, a process of manufacturing an article includes, in almost all cases, a heat treatment step for heating and/or drying purposes. For example, ceramic green pieces are dried by heating workpieces in an atmosphere of a reduced pressure. Under a reduced pressure, the vapor pressure is lowered, and the workpieces may be dried at a comparatively low temperature, with a reduced possibility of chemical changes and cracks of the workpieces. Further, the drying under a reduced pressure may be achieved in a shorter time. In particular, a vacuum microwave heating by means of high-frequency electromagnetic waves permits the workpiece to be heated internally, and assures even or uniform drying of the workpiece with a high thermal efficiency.

Conventionally, such a vacuum microwave heating is conducted in a comparatively large heating chamber which is held under a reduced pressure. Workpieces are placed on a turntable located within the heating chamber, and are irradiated by microwave radiation while the workpieces are moved with rotating movements of the turntable. In this type of batch heating using a turntable, the size and installation area of the turntable must be increased as the amount of processing of the workpieces is increased. However, the installation space in the heating chamber is limited, and consequently the processing capacity of the system is limited.

In the meantime, a microwave heating under the atmospheric pressure is known, wherein a conveyor is used to successively feed the workpieces through a heating chamber. However, the use of such a conveyor for a continuous vacuum drying operation has been considered difficult in view of various problems to be solved, for example, in maintaining pressure tightness of the heating chamber, and in connecting a vacuum pump as a vacuum source to the heating chamber.

SUMMARY OF THE INVENTION

It is therefore a primary object of the present invention to provide a vacuum conveyor system which permits a continuous drying operation of workpieces under a reduced pressure, by means of successive transfer of the workpieces through a processing zone such as a microwave heating zone, in particular.

According to the present invention, there is provided a vacuum conveyor system, comprising: (a) conveyor means having plural mounting portions on which workpieces are mounted, said mounting portions being spaced from each other along an endless track of the conveyor means; (b) drive means for driving said conveyor means along said endless track; (c) a plurality of enclosure means provided on said plural mounting portions of the conveyor means, respectively, for forming air-tight enclosed chambers in which the workpieces mounted on the mounting portions are accommodated, respectively; (d) a vacuum source for drawing an atmosphere from said enclosed chambers; and (e) suction piping means disposed along said conveyor means and travelling together with said conveyor means along said endless track, said suction piping means being connected to said vacuum source and having connections which are adapted to communicate with said enclosed chambers to evacuate the enclosed chambers to a predetermined reduced pressure.

The vacuum conveyor system constructed according to the invention as described above, is capable of transferring the workpieces in the enclosed chambers under a reduced pressure, through a predetermined heating zone while the conveyor means is driven. Therefore, the instant conveyor system makes it possible to perform a continuous drying operation, particularly, a microwave heating and drying operation under a reduced pressure, while the workpieces are moved by the conveyor means. This arrangement enjoys advantages of the microwave heating, and provides an improvement in processing capacity of the heating and drying equipment, with reduced size and installation space of the equipment. Further, the instant conveyor system permits a microwave heating of such workpieces that are difficult to be moved by a turntable, or of such workpieces that should avoid the use of a turntable. It will be understood that the vacuum conveyor system may be effectively used for any operations other than vacuum drying, which require the workpieces to be transferred by a conveyor while the individual workpieces are accommodated in separate chambers under a reduced pressure. It is noted that the term "vacuum" used in connection with this invention should be interpreted to mean a partial vacuum, that is, a reduced pressure lower than the atmospheric pressure, which is established by evacuation.

BRIEF DESCRIPTION OF THE DRAWING

The above and other objects, features and advantages of the present invention will become more apparent from reading the following detailed description of preferred embodiments of the invention, when considered in connection with the accompanying drawing, in which:

FIG. 7 is an enlarged view of a portion indicated at VII in FIG. 6;

FIGS. 8 and 9 are fragmentary plan views, showing modified forms of suction piping means;

FIGS. 10, 11 and 12 are schematic views, illustrating modified forms of connections between a vacuum pump unit and a travelling conduit assembly;

FIG. 13 is a schematic view of a modified form of a vacuum pump unit; and

FIGS. 14, 15 and 16 are schematic cross sectional views of modified forms of a mechanism for activating a change-over valve.

DETAILED DESCRIPTION OF THE PREFERRED EMBODIMENTS

To further clarify the concept of the present invention, several preferred embodiments of the invention will be described in detail, by reference to the appended drawings.

Figure 1:
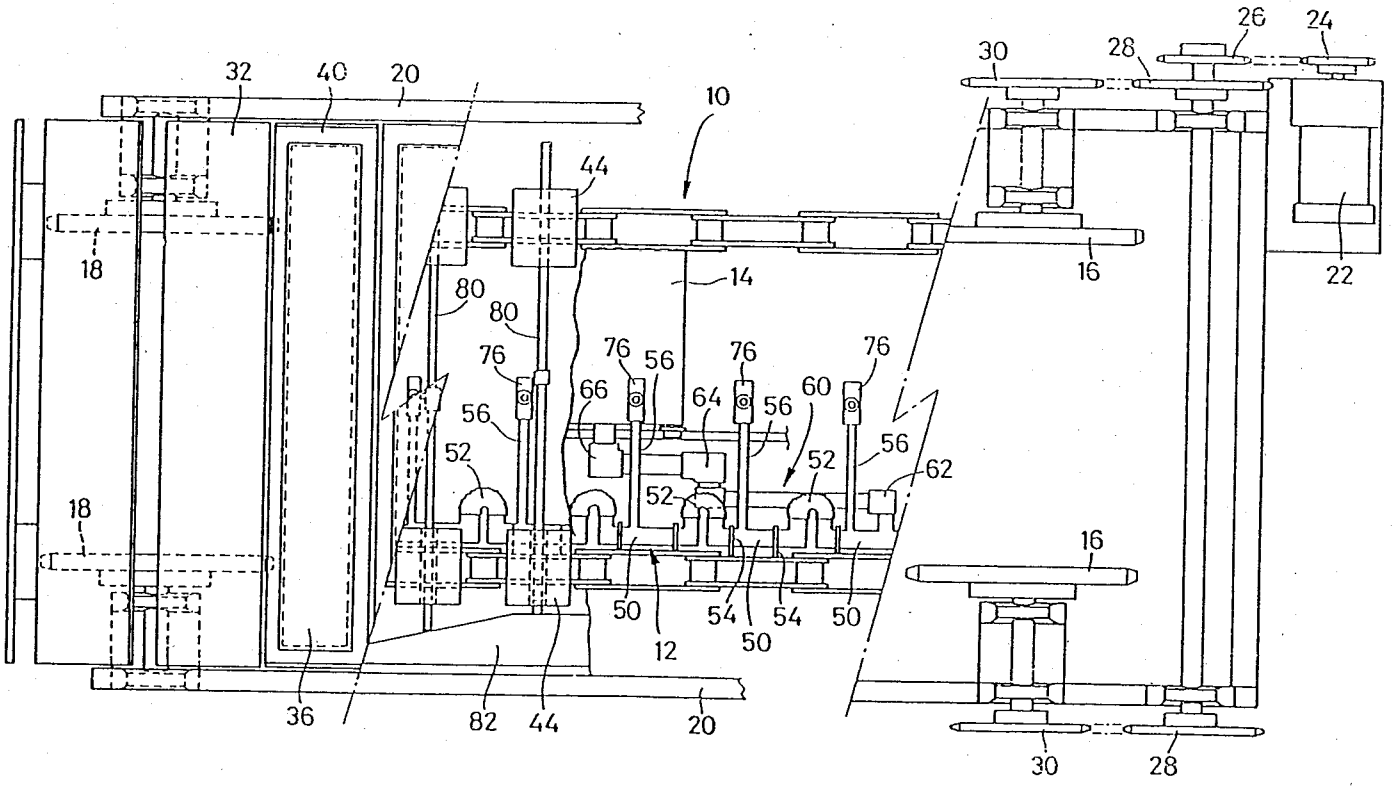
FIG. 1 is a partially cutaway plan view of one embodiment of a vacuum conveyor system.
Figure 2:
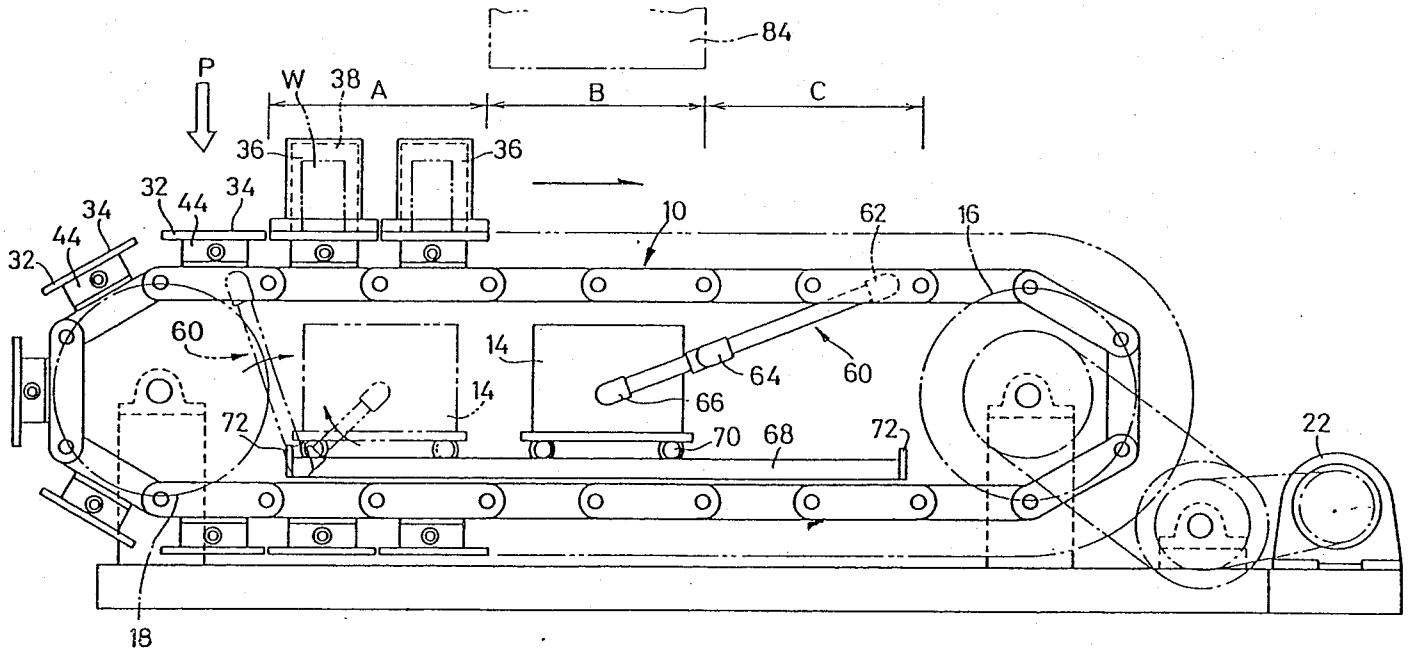
FIG. 2 is a front elevational view of the vacuum conveyor system of FIG. 1.
Figure 3:
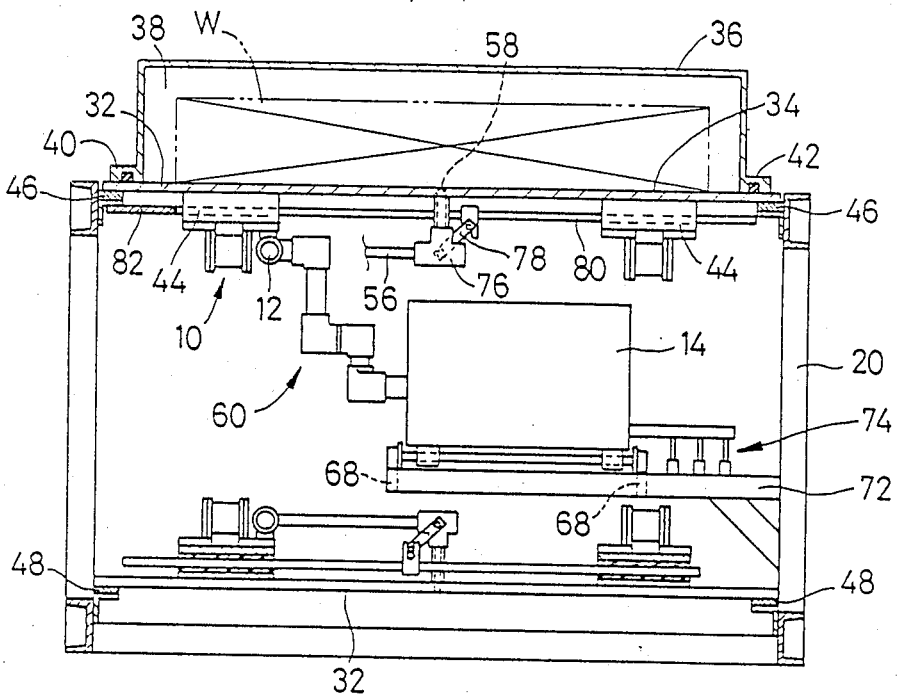
FIG. 3 is an elevational view in transverse cross section of the vacuum conveyor system of FIG. 1.

Referring first to FIGS. 1–3, there is shown one embodiment of a vacuum conveyor system which comprises: a chain conveyor 10 serving as a major part of conveyor means; a flexible travelling conduit assembly 12 serving as a major part of suction piping means; and a vacuum pump unit 14 serving as a suction source. As shown most clearly in FIG. 1, the chain conveyor 10 has a pair of chains which are disposed in space-apart and parallel relation with each other. The chains engage sprockets 16, 18 and are driven along an endless track or path. The sprockets 16, 18, which define a span of the chains, are supported rotatably by a frame 20 of the conveyor system, and are operatively connected to a drive motor 22 by means of chains and sprockets 24, 26, 28, 28 and 30, 30.

The chain conveyor 10 carries a plurality of pallets 32 fixed thereto. The pallets 32 are disposed so as to extend across the width of the chain conveyor 10, i.e., perpendicularly to a direction of movement of the chains. As indicated in FIG. 2, the pallets 32 are mounted on the outer surfaces of respective links which constitute the chains, whereby the pallets 32 are moved together with the chain conveyor 10 along the endless track. Each of the pallets 32 has a mounting surface 34 on which a workpiece W to be processed is mounted. In operation, a covering member 36 in the form of a container is placed on the mounting surface 34 to cover the workpiece W mounted on the mounting surface 34, as most clearly shown in FIG. 3. This covering member 36 serves as enclosure means which cooperates with the mounting surface 34 to define an air-tight enclosed chamber 38. The covering member 36 is given a rigidity sufficient to withstand a reduced pressure established within the enclosed chamber 38. The covering member 36 has a flange 40 at the periphery of its open end. To maintain air tightness between the covering member 36 and the mounting surface 34 of the pallet 32, the flange 40 is provided with a sealer 42.

More specifically, the individual pallets 32 are fixed to the chain conveyor 10 via respective mountings 44, 44 which are secured to the links of the chains. As shown in FIG. 3, the pallets 32 are slidably supported, at their opposite ends, by a pair of upper guide rails 46, 46, and a pair of lower guide rails 48, 48, all of which are fixed to the frame 20. These guide rails 46, 48 contribute to preventing a slack of the chain conveyor 10.

The travelling conduit assembly 12 is secured to the inner side of one of the chains of the chain conveyor 10, as depicted in FIG. 1, so that the conduit assembly 12 is rotated with the chain along the endless track. The travelling conduit assembly 12 includes a plurality of rigid metal tubes 50 which are fixed to the respective links of the chain by metal retainers 54, 54. These metal tubes 50 are spaced from each other by a suitable distance along the chain, and are connected to each other by flexible joints 52 of bellows' type made of synthetic resins or other flexible materials. Described in more detail, each of the metal tube 50 is bent inwardly toward the other chain at its opposite open ends. The flexible joints 52 are connected to the adjacent bent open ends of the adjacent metal tubes 50, such that the flexible joints 52 take the form of letter U. Thus, the flexible joints 52 permit the travelling conduit assembly 12 to be flexed along curvatures of the sprockets 16, 18, like the chains which are made up of the plural links.

Connection tubes 56 equal in number to the enclosed chambers 38 are connected at their one end to the metal tubes 50 so as to extend from a central part of each metal tube 50 toward the other chain. The other ends of the connection pipes 56 are connected to communication holes 58 which are formed through the thickness of the pallets 32 and which are open in the mounting surfaces 34 of the pallets 32, whereby the travelling conduit assembly 12 is connected to the individual enclosed chambers 38 via the connection pipes 56 and the communication holes 58. In the meantime, one end of a movable connection pipe 60 is connected to one of the plural metal tubes 50 via a rotary coupling 62, as shown in FIG. 1. The movable connection pipe 60 consists of two pipe elements which are connected to each other by a rotary coupling 64, as shown in FIG. 2, so that the two elements are pivotable relative to each other about the rotary coupling 64. The other end of the connection pipe 60 is connected via another rotary coupling 66 to the vacuum pump unit 14.

The vacuum pump unit 14 has a vacuum pump, and a drive device such as an electric motor to drive the vacuum pump. Since the vacuum pump unit 14 is well known in the art, detailed description will not be provided in the interest of brevity and simplification. As shown in FIG. 2, the vacuum pump unit 14 is adapted to roll on four rolls 70 which in turn roll on a pair of guide rails 68, 68. These guide rails 68, 68 are disposed within the endless track of the chain conveyor 10 (in FIG. 2) and extend horizontally parallel to straight paths of the endless track. As shown most clearly in FIG. 3, the guide rails 68 are supported by brackets 72 which are fixed to a vertically middle part of the frame 20 so as to extend across the length of the guide rails 68. In this arrangement, the vacuum pump unit 14 is supported by the guide rails 68 movably in opposite directions along the straight paths of the endless track of the chain conveyor 10, without interference with the endless track.

As the vacuum pump unit 14 is connected to the previously described travelling conduit assembly 12 by means of the movable connection pipe 60, the vacuum pump unit 14 is pulled and pushed by the connection pipe 60 and is consequently reciprocated on the guide rails 68 when the travelling conduit assembly 12 is rotated together with the chain conveyor 10. It will be understood that the two pipe elements of the movable connection pipe 60 connected by the rotary coupling 64 are pivoted relative to each other and to the chain and the pump unit 14 by means of the rotary couplings 62, 64 and 66, as the chain conveyor 10 is rotated with the rotary coupling 62 passing along the sprockets 16, 18. One phase of the movable connection pipe 60 is indicated in broken line in FIG. 2. Thus, the movable connection pipe 60 connected to the vacuum pump unit 14 can follow the rotary movement of the chain conveyor 10.

The drive device such as an electric motor to drive the vacuum pump in the vacuum pump unit 14 is supplied with electric power through a power supply 74 indicated in FIG. 3. The vacuum pump draws the atmosphere from the enclosed chambers 38 through the movable connection pipe 60, travelling conduit assembly 12 and individual connection tubes 56 connected to the communication holes 58 in the pallets 32, whereby the enclosed chambers 38 are held under vacuum (more precisely, under a suitable reduced pressure).

Each of the connection tubes 56 is provided with a rotary change-over valve 76 adjacent to the communication hole 58. The change-over valve 76 is operated between a first position in which the enclosed chamber 38 communicates with the atmosphere, and a second position in which the enclosed chamber 38 communicates with the vacuum pump unit 14 via the travelling conduit assembly 12, etc. That is, the enclosed chamber 38 is held under a reduced pressure when the change-over valve 76 is placed in its second position. The first and second positions are selected by a switch lever 78 which is pivotable within a predetermined angular range. The free end of the switch lever 78 is connected to an operating rod 80 by means of engagement of a U-shaped recess in the rod 80 and a pin on the switch lever 78. Each of the operating rods 80 corresponding to the switch levers 78 for the individual pallets 32, is disposed so as to extend parallel to a plane of pivot of the switch lever 78, and in a direction perpendicular to the length of the chain conveyor 10 (across the width of the conveyor 10). More particularly, the operating rods 80 extend through the mountings 44, 44 for the pallets 32, and are slidably supported in bushings fixed in the mountings 44, 44. As most clearly shown in FIG. 1, the operating rods 80 which are moved togehter with the chain conveyor 10 are adapted to slidably contact a cam surface of a cam plate 82 which extends inwardly from an upper part of one side wall of the frame 20.

The cam surface 82 of the cam plate 82 is shaped to have a tapered portion so that the operating rods 80 are axially moved to the right (in FIG. 3) in order to place the change-over valve 76 in its second position (for communication with the vacuum pump unit 14) while the rods 80 are moved through an area A indicated in FIG. 2, together with the chain conveyor 10. Further, the tapered surface terminates in a straight portion which corresponds to an area B within which the change-over valve 76 is kept in its second position. A second cam plate (not shown) is provided on an upper part of a side wall of the frame 20 opposite to said one side wall on which the cam plate 82 is provided. This second cam plate is shaped so that the operating rods 80 are axially moved to the left (in FIG. 3) to place the change-over valve 76 in its first position (for communication with the atmosphere) while the rods 80 are moved through an area C. Once the change-over valve 76 has been placed in its first or second position, these positions are maintained due to a friction force existing between the rod 80 and the bushings in the mountings 44, 44.

The thus constructed vacuum conveyor system is suitably used for practicing a drying process under a reduced pressure, for example, a microwave heating operation under a reduced pressure. In this case, a heating device such as a microwave heating device 84 is disposed, at a location corresponding to the area B, so as to straddle over the width of the chain conveyor 10. With the chain conveyor 10 driven by the motor 22, the pallets 32 on the chain conveyor 10 are moved in a direction indicated by an arrow in FIG. 2, in an intermittent fashion, or continuously at a predetermined speed. The workpieces W are mounted on the mounting surfaces 34 of the pallets 32 at a loading position indicated at P in FIG. 2. Subsequently, the covering members 36 are set on the pallets 32 by an operator or by a suitable means such as a robot, in order to enclose the workpieces W in the enclosed chambers 38.

While the workpiece W is moved through the area A, the corresponding operating rod 80 is moved to the right by the tapered surface of the cam plate 82, whereby the change-over valve 76 is moved from its first position toward its second position. When the operating rod 80 has reached the end of the tapered surface (end of the aera A), the change-over valve 76 has been placed in its second position. Thus, the air in the enclosed chamber 38 is drawn by the vacuum pump unit 14 and the workpiece W is held under a predetermined reduced pressure. While the workpiece W is moved through the area B, the workpiece W is irradiated by a microwave radiation which is generated from the microwave heating device 84 and conducted through the covering member 36, whereby the workpiece W is heated and dried by electromagnetic energy.

Subsequently, the workpiece W is moved through the area C, and the operating rod 80 is pushed back to the left (in FIG. 2) by the cam surface of the second cam plate (not shown), whereby the change-over valve 76 is moved to its first position to bring the enclosed chamber 38 into communication with the atmosphere. Successively, the covering member 36 is removed or separated from the pallet 32, and the dried workpiece W is dismounted from the pallet 32 by a suitable unloading means. The unloaded pallet 32 is then moved along the endless track toward the loading position P.

As discussed above, the individual workpieces W are enclosed in the respective air-tight spaces (enclosed chambers) 38, which are evacuated while they pass the heating zone provided by the microwave heating device 84. This conveyor system for a continuous feed of the workpieces to heat and dry the workpieces will replace a conventional turntable on which a batch of workpieces is heated by a heating furnace that covers the entire area of the turntable. Hence, the present conveyor system makes it possible to reduce a heating area in which the workpieces are heated and dried, whereby the heating efficiency may be significantly improved.

In the case where the conveyor system described hitherto is employed for microwave heating of workpieces under a reduced pressure, it is preferred that the covering members 36 be made of fluorine-contained resin, polypropylene, glass, ceramics, or other materials which have a small dielectric dissipation factor (dielectric loss tangent) tan $\delta$. If, however, the conveyor system is used for vacuum heating by infrared rays or by other external heating means, the covering members 36 may be made of suitable materials having a high resistance to heat.

Referring next to FIGS. 4–7, another embodiment of the invention will be described. In the figures, the same reference numerals and letters as used in FIGS. 1–3 will be used to identify the corresponding elements. To avoid redundance, repeated description of these elements will not be provided.

Figure 6:
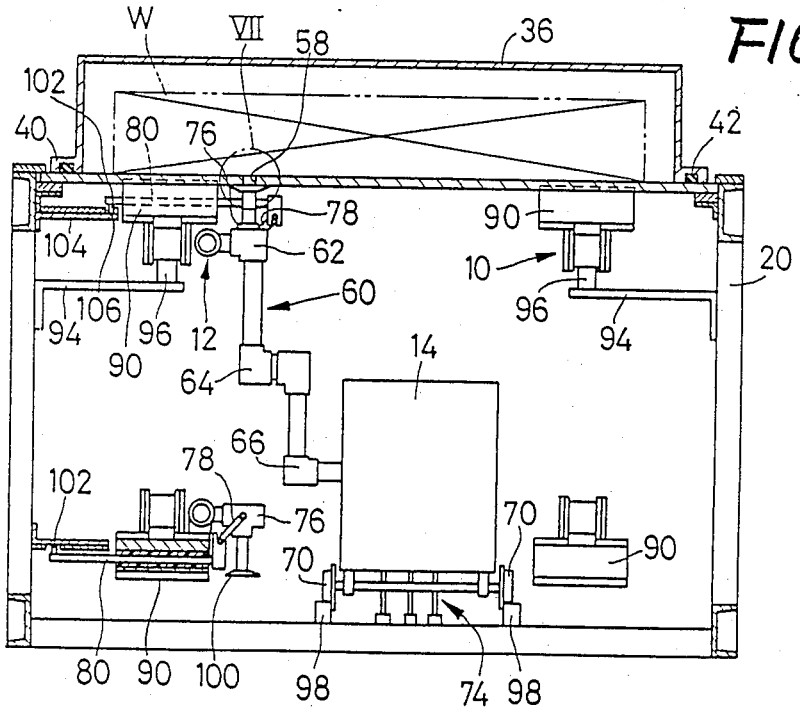
FIG. 6 is an elevational view in transverse cross section of the embodiment of FIG. 4.
Figure 4:
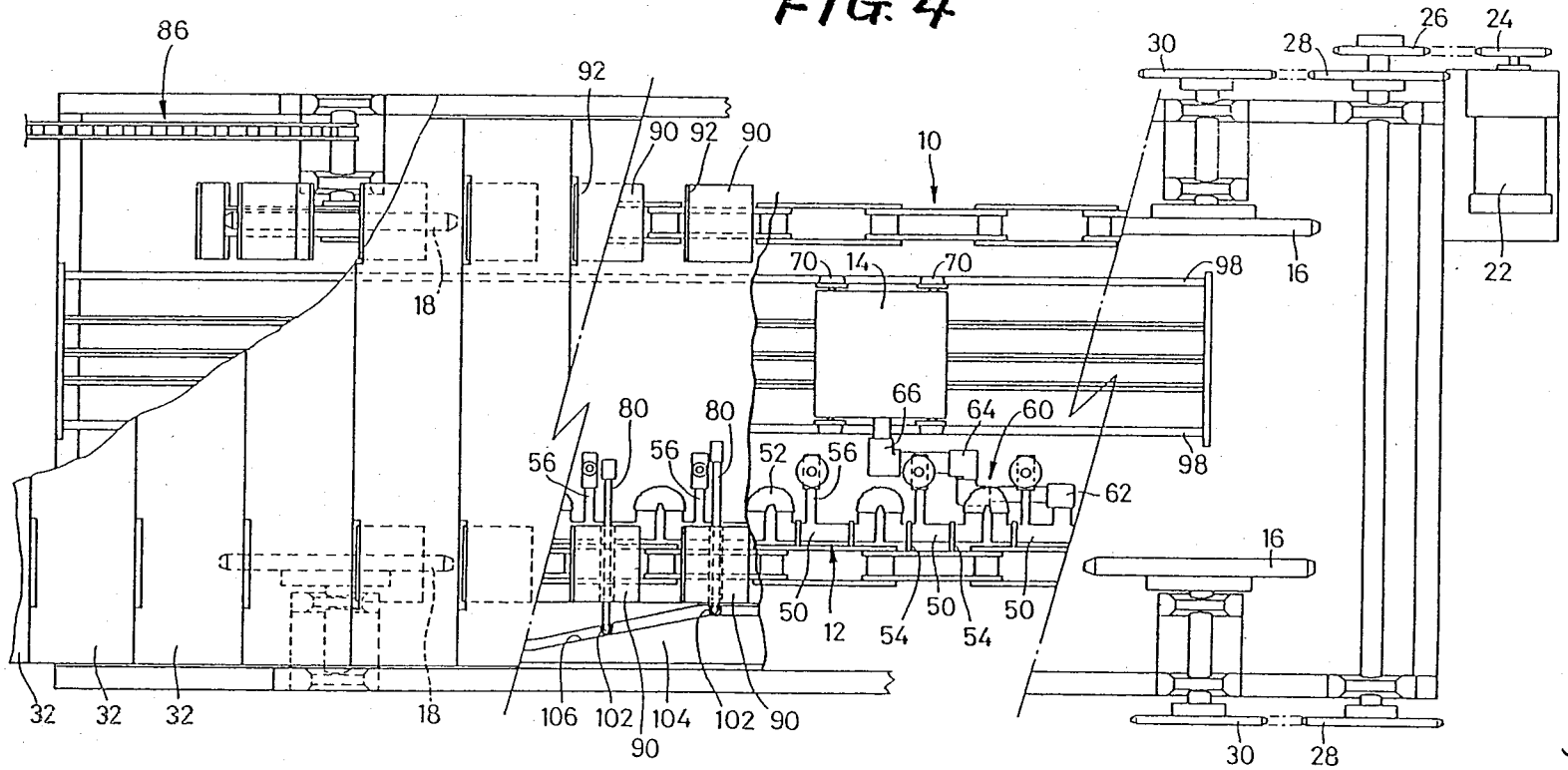
FIG. 4 is a partially cutaway plan view of another embodiment of the invention.

In this modified embodiment, a first roller conveyor 86 and a second roller conveyor 88 are connected to the chain conveyor 10 at upstream and downstream ends of the upper straight path of its endless track, such that the first and second roller conveyors 86, 88 are flush with the upper straight portion of the chain conveyor 10 in the horizontal plane. Unlike the pallets 32 used in the preceding embodiment, pallets 32 in the present embodiment are not fixed to the chain conveyor 10. More specifically, pairs of mountings 90 are secured to the corresponding pairs of links of the parallel chains of the chain conveyor 10. The pallets 32 and the workpieces W mounted thereon are fed by the roller conveyor 86 toward the chain conveyor 10, and are received by the mountings 90. The pallets 32 are positioned by positioning portions 92 which protrude from the mounting surface of the mountings 90. Thus, the pallets 32 are fed on the upper part of the endless track of the chain conveyor 10. At the end of the chain conveyor 10, the pallets 32 are transferred onto the roller conveyor 88, and separated from the mountings 90 fixed to the chain conveyor 10. As shown in FIG. 6, the two chains of the chain conveyor 10 are supported at their lower surfaces by guide rails 96, 96 on brackets 94, 94 fixed to the frame 20, to prevent a downward slack of the upper path of the endless track.

In the meantime, the vacuum pump unit 14 is adapted to roll on the rollers 70 on a pair of guide rails 98, 98 which are disposed below the lower path of the endless track of the chain conveyor 10, whereby the pump unit 14 is reciprocated in a horizontal plane. In this connection, it is noted that the vacuum pump unit 14 will not interfere with the pallets 32 and the chain conveyor 10 (more particularly, the mountings 90), because the pallets 32 are removed from the chain conveyor 10, and the mountings 90 are spaced from the vacuum pump unit 14 by sufficient distances in the direction of width of the chain conveyor 10.

The connection tubes 56 (FIG. 4) extending from the travelling conduit assembly 12 are provided at their ends with rubber suckers 100 as shown in enlargement in FIG. 7. When the pallet 32 is received by the corresponding pair of mountings 90, the rubber sucker 100 sticks at its periphery to the lower surface of the pallet 32, whereby the connection tube 56 communicates with the enclosed chamber 38 via the communication hole 58.

To control the change-over valves 76 (FIG. 6) provided on the connection tubes 56, the operating rods 80 are supported by the mountings 90 so that the rods 80 are slidable horizontally. Each operating rod 80 is connected at its one end to the change-over valve 76, and is provided at its other end with a cam follower 102 which has a vertical axis of rotation. The cam follower 102 fits in a cam groove 106 formed in a cam plate 104 which is fixed to one side wall of the frame 20. The cam groove 106 provides a positive motion cam which is shaped so that the operating rod 80 moving through the area A of FIG. 5 may be axially moved in one direction to operate the change-over valve 76 from its first position to its second position for communication of the enclosed chamber 38 with the vacuum pump unit 14, and so that the operating rod 80, while moving through the area B, may maintain the same position to hold the change-over valve 76 in the second position. Further, the cam groove 106 is formed so that the operating rod 80 moving through the area C is axially moved in the other direction to return the change-over valve 76 to its first position for communication of the enclosed chamber 38 with the atmosphere.

Figure 5:
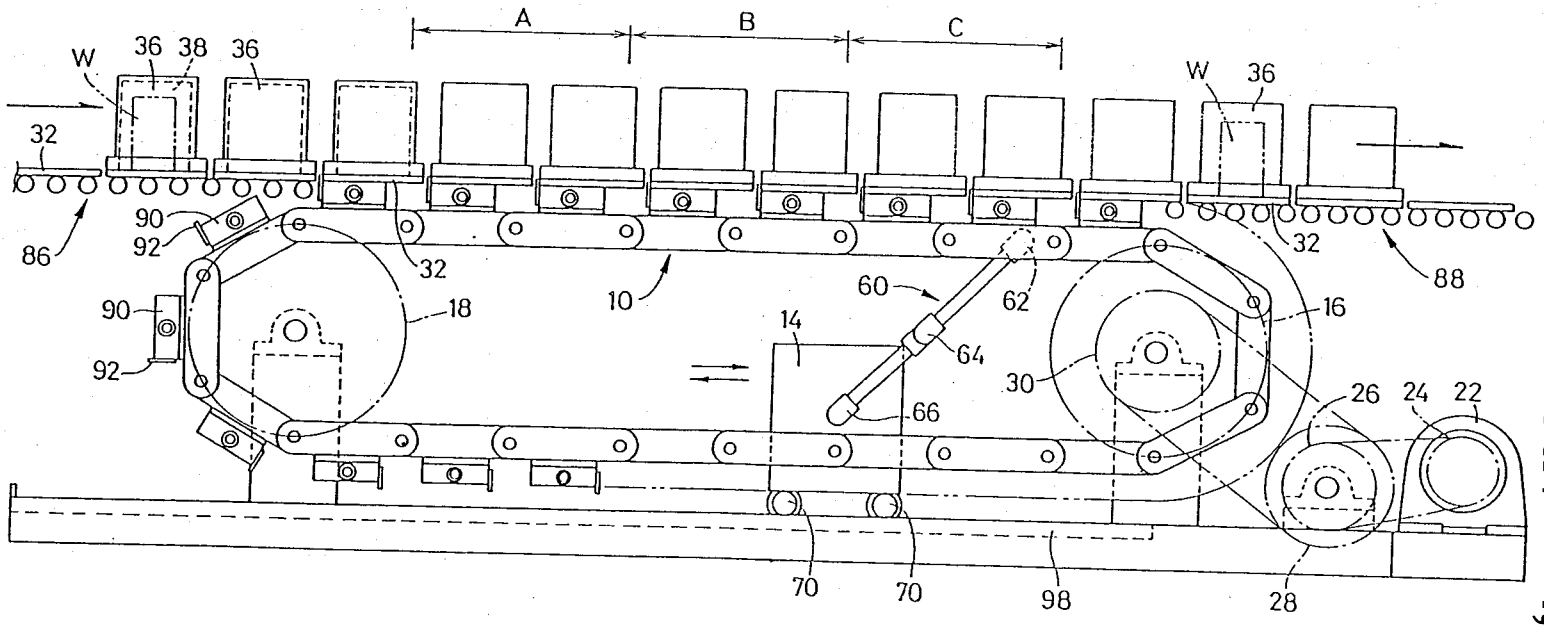
FIG. 5 is a front elevational view of the embodiment of FIG. 4.

The vacuum conveyor system described above may be used also in combination with a suitable heating device such as a microwave heating device, which is disposed over the area B of FIG. 5, to perform a continuous heating and drying operation of the workpieces W under a reduced pressure. Further, the present embodiment is advantageous in that the roller conveyor 86 automatically loads the chain conveyor 10 with successive workpieces W covered by the covering member 36, both mounted on the pallet 32, while the roller conveyor 88 automatically unloads the chain conveyor 10 after the workpieces W have been processed, i.e., the assemblies of the workpiece W, covering member 36 and pallet 32 are transferred to the roller conveyor 88, which feeds the workpieces W to a subsequent process. Consequently, the workpieces W may be processed with an improved efficiency.

While two preferred embodiments of the invention have been described for illustrative purpose only, it is to be understood that the invention may be otherwise embodied.

For example, the travelling conduit assembly 12 may be formed by plural straight metal tubes 50, as shown in FIG. 8, which are disposed in spaced-apart relation along one of the chains of the chain conveyor 10, and which are connected at their ends by flexible couplings 52 of synthetic resin, rubber or other suitable flexible materials. In this case, too, the connection tubes 56 extend from an intermediate part of the respective straight metal tubes 50. It is also possible to constitute the travelling conduit assembly 12 by a continuous flexible hose made of a synthetic resin or rubber material, as illustrated in FIG. 9, in place of the metal tubes 50. In this instance, the flexible hose, which is fixed to the chain conveyor 10 with the retainers 54, is formed with fittings 108 for connection with the connection tubes 56, and with fittings 110 for connection with the movable connection pipe 60.

Further, the movable connection pipe 60 connecting the vacuum pump unit 14 and the travelling conduit assembly 12 may be a single metal pipe, as shown in FIG. 10. In this case, as is apparent from FIG. 11, a distance L of reciprocation of the vacuum pump unit 14 during rotation of the chain conveyor 10 may be slightly longer than that where the movable connection pipe 60 is made up of two pipes pivotable to each other as in the previous embodiments.

The movable connection pipe 60, which is rigid in the illustrated embodiments, may be made of a flexible material. In this case, a chain 112, a rope or other suitable protective member is connected between the rotary couplings 62 and 66 at the opposite ends of the flexible pipe 60, as shown in FIG. 12, so that the chain 112 or other protective member withstands a pulling force of the chain conveyor 10, which is otherwise exerted to the flexible pipe 60 to reciprocate the vacuum pump unit 14. In other words, the protective member protects the flexible pipe 60 against an excessive pulling force of the chain conveyor 10. Although the vacuum pump unit 14 is disposed in the installation area of the chain conveyor 10, it is possible that the pump unit 14 is installed outside the chain conveyor 10, as indicated in FIG. 13, so that the pump unit 14 may be reciprocated alongside one of the chains, without an interference with the conveyor 10.

FIG. 14 shows a modified form of an arrangement for controlling the operation of the change-over valves 76 provided on the connection tubes 56. In the figure, reference numeral 114 indicates a spring for biasing the operating rod 80 in one axial direction thereof to hold the corresponding end of the operating rod 80 in pressed contact with the cam surface of the cam plate 82. Further, the operating rod 80 may be disposed vertically rather than horizontally, such that the cam follower 102 at its lower end engages the cam groove 106 formed in the cam plate 104, as illustrated in FIG. 15. It is also possible that the vertically disposed operating rod 80 is biased downwardly by the spring 114, as shown in FIG. 16, so that its lower end is in pressed contact with the cam surface of the cam plate 82.

It will be obvious that the operating rod 80 may be activated, not by a cam, but by a cylinder which is controlled by a solenoid valve in response to a signal from a limit switch or a proximity switch provided to detect the passage of the pallet 32 or other members moved with the chain conveyor 10. Further, the change-over valve 76 which is mechanically operated in the illustrated embodiments, may be replaced by a solenoid-operated valve which is controlled based on a signal from a limit switch or other sensors, as indicated above.

Various modifications may be made in connection with the covering members 36. For example, the covering member 36 may be hinged to the pallet 32 so as to allow easy mounting and removal on and from the pallet 32. Provisions may be made for biasing the covering member 36 toward the pallet 32 with a spring or other biasing means, and for permitting the covering member 36 to be moved against a biasing action of the biasing means, to an open position for mounting and dismounting the workpiece W. Further, the covering member 36 may be biased toward its open position, and held in its closed position by suitable latch means after the workpiece has been accommodated in the covering member 36.

Although the vacuum conveyor system according to the invention is suitable particularly for heating and drying the workpieces under a reduced pressure, it is also effective for effecting various treatments which do not accompany a heating process, for example, for a continuous operation to remove binders contained in ceramic green pieces. Further, the instant vacuum conveyor system may be effectively utilized for any treatments of workpieces which require a transfer of workpieces while held in separate enclosed chambers under a reduced pressure.

As is apparent from the foregoing embodiments of the invention, the vacuum conveyor system constructed according to the invention is characterized in that plural enclosed chambers are formed along conveyor means to accommodate workpieces which are moved by the conveyor means, and that the conveyor means is provided with suction piping means which travels with the conveyor means in order to evacuate the individual enclosed chambers, so that the workpieces are moved while they are kept under a reduced pressure. When the vacuum conveyor system is used for a vacuum drying process by means of microwave radiation, the workpieces may be dried continuously while they pass a limited heating zone provided part way through the path of the conveyor. This is contrary to a heating method of batch type in which the heating device covers the entire area in which the workpieces are placed. The vacuum conveyor system of the invention may find other applications where the workpieces are continuously fed under a reduced pressure.

What is claimed is:

1. A vacuum conveyor system, comprising:

conveyor means having plural mounting portions on which workpieces are mounted, said mounting portions being spaced from each other along an endless track of the conveyor means;

drive means for driving said conveyor means along said endless track;

a plurality of enclosure means provided on said plural mounting portions of the conveyor means, respectively, for forming air-tight enclosed chambers in which the workpieces mounted on the mounting portions are accommodated, respectively;

a vacuum source for drawing an atmosphere from said enclosed chambers; and suction piping means disposed along said conveyor means and travelling together with said conveyor means along said endless track, said suction piping means being connected to said vacuum source and having connections which are adapted to communicate with said enclosed chambers to evacuate the enclosed chambers to a predetermined reduced pressure.

2. A vacuum conveyor system according to claim 1, wherein said conveyor means comprises sprockets driven by said drive means, a chain conveyor engaging said sprockets and rotated along said endless track, and pallets which are movable by said chain conveyor and constitute said mounting portions, said plurality of enclosure means comprising covering members cooperating with said pallets to form said air-tight enclosed chambers.

3. A vacuum conveyor system according to claim 2, wherein said pallets are fixed to said chain conveyor and moved with the chain conveyor along said endless track.

4. A vacuum conveyor system according to claim 2, wherein said pallets are moved on said chain conveyor over a predetermined portion of said endless track, said pallets being separated from said chain conveyor over the remaining portion of the endless track.

5. A vacuum conveyor system according to claim 2, wherein said suction piping means comprises a flexible travelling conduit assembly attached to a side of said chain conveyor so as to run along said endless track, and plural connection tubes which communicate at their one end with said travelling conduit assembly and are adapted to communicate at the other end with said enclosed chambers, said connection tubes constituting said connections, and said travelling conduit assembly being connected to said vacuum source.

6. A vacuum conveyor system according to claim 5, wherein said plural connection tubes are open in upper surfaces of the corresponding pallets.

7. A vacuum conveyor system according to claim 5, wherein said travelling conduit assembly comprises plural rigid tubes which are fixed to the side of said chain conveyor and are spaced from each other along said endless track, and further comprises plural flexible joints which connects said rigid tubes and cooperate with the rigid tubes to form a flexible conduit along said endless track, said connection tubes being connected to said rigid tubes, respectively.

8. A vacuum conveyor system according to claim 5, wherein said vacuum source is a vacuum pump unit which comprises a vacuum pump and drive means for operating said vacuum pump, said vacuum pump unit being disposed such that the vacuum pump unit is movable in opposite directions substantially parallel to said endless track of the chain conveyor, without an interference with the endless track, said vacuum conveyor system further comprising a movable connection pipe which connects said vacuum pump unit and said travelling conduit assembly, a rotary motion of said chain conveyor and said travelling conduit assembly being imparted to said vacuum pump unit through said movable connection pipe, to cause said vacuum pump unit to be reciprocated following said rotary motion of the chain conveyor and the travelling conduit assembly.

9. A vacuum conveyor system according to claim 8, wherein said movable connection pipe comprises plural pipes which are connected by a rotary coupling.

10. A vacuum conveyor system according to claim 5, wherein each of said connection tubes communicating with said travelling conduit assembly is provided with a change-over valve which is operable between a first position for communication of the corresponding enclosed chamber with the atmosphere, and a second position for communcation of the corresponding enclosed chamber with said vacuum source through said travelling conduit assembly.

11. A vacuum conveyor system according to claim 10, further comprising a frame for supporting said chain conveyor, and a cam fixed to said frame, said change-over valve being operatively connected to said cam and selectively placed in said first and second positions by an action of said cam.

12. A vacuum conveyor system according to claim 1, wherein the workpieces accommodated in the corresponding enclosed chamber under the reduced pressure are moved to pass a predetermined heating zone while said conveyor means is driven by said drive means, the vacuum conveyor system constituting a part of a vacuum drying system.

13. A vacuum conveyor system according to claim 12, wherein said vacuum drying system comprises a microwave heating device generating high-frequency electromagnetic waves for heating the workpieces.

* * * * *